US008636412B2

(12) United States Patent
Wang et al.

(10) Patent No.: US 8,636,412 B2
(45) Date of Patent: Jan. 28, 2014

(54) SHOPPER BAG

(75) Inventors: Alexander Wang, New York, NY (US); Claudia Kim, New York, NY (US)

(73) Assignee: Alexander Wang Incorporated, New York, NY (US)

( * ) Notice: Subject to any disclaimer, the term of this patent is extended or adjusted under 35 U.S.C. 154(b) by 231 days.

(21) Appl. No.: 13/077,313

(22) Filed: Mar. 31, 2011

(65) Prior Publication Data

US 2012/0251017 A1 Oct. 4, 2012

(51) Int. Cl.

| | |
|---|---|
| ***B65D 33/10*** | (2006.01) |
| ***B65D 33/06*** | (2006.01) |
| ***B65D 33/16*** | (2006.01) |
| ***B65D 30/10*** | (2006.01) |

(52) U.S. Cl.
USPC ..... 383/10; 383/26; 383/77; 383/121

(58) Field of Classification Search
USPC ..... 383/24–27, 10, 77, 98, 99, 121; 224/600, 601, 607, 613, 615, 580
See application file for complete search history.

(56) References Cited

U.S. PATENT DOCUMENTS

| | | | | |
|---|---|---|---|---|
| 3,199,766 | A * | 8/1965 | Vineberg | 383/10 |
| 3,610,517 | A | 10/1971 | Honsel | |
| 4,078,595 | A | 3/1978 | Mittelmann | |
| 4,156,446 | A | 5/1979 | Nathan | |
| 4,273,274 | A * | 6/1981 | Freistadt | 294/141 |
| 4,717,262 | A * | 1/1988 | Roen et al. | 383/120 |
| 4,878,606 | A | 11/1989 | Miller | |
| 4,895,456 | A | 1/1990 | Morita | |
| 5,062,717 | A | 11/1991 | Shockley | |
| 5,282,686 | A | 2/1994 | Haber | |
| 5,624,048 | A * | 4/1997 | Sander et al. | 215/395 |
| 5,845,833 | A | 12/1998 | Murphy | |
| 5,882,117 | A | 3/1999 | Laffon | |
| 5,957,354 | A * | 9/1999 | Mentken | 224/614 |
| 6,012,842 | A | 1/2000 | Openiano | |
| 6,071,010 | A | 6/2000 | Chan | |
| 7,160,028 | B1 * | 1/2007 | Linday | 383/4 |

(Continued)

FOREIGN PATENT DOCUMENTS

| | | | | |
|---|---|---|---|---|
| EP | 308039 A2 * | 3/1989 | | A45C 3/04 |
| FR | 2633253 A1 * | 12/1989 | | B65D 33/12 |

OTHER PUBLICATIONS

International Search Report issued Jun. 28, 2012, in co-pending PCT Application PCT/US2012/031067 (2 pages).

(Continued)

*Primary Examiner* — Jes F Pascua
(74) *Attorney, Agent, or Firm* — McCarter & English, LLP

(57) ABSTRACT

A shopper bag having a substantially rectangular opening at the top and closed bottom for articles to be placed into and removed from the bag. The bag includes a front and opposed back panel with a closed rectangular bottom to provide the rectangular mouth opening at the top. A first handle is mounted on one panel at the opening and an horizontal slit is formed in the opposed panel so that the upper portion of the slit and the first handle can be used to lift the bag. A larger collar is formed on the same side as the first handle. The collar is configured to fit through, the horizontal slit opening to draw both opposed panels together at the mouth and allow a user to place the collar on one's neck or shoulder to carry the bag.

11 Claims, 5 Drawing Sheets

(56) References Cited

U.S. PATENT DOCUMENTS

| | | | | |
|---|---|---|---|---|
| 7,757,918 | B2 | 7/2010 | Merzon | |
| 7,841,374 | B2 | 11/2010 | Berk | |
| D672,962 | S * | 12/2012 | Wang et al. | D3/318 |
| 2007/0031067 | A1 | 2/2007 | Gebhardt | |
| 2010/0021088 | A1* | 1/2010 | Wilfong, Jr. | 383/23 |
| 2010/0092110 | A1* | 4/2010 | Simhony et al. | 383/13 |
| 2011/0052100 | A1 | 3/2011 | Eisenberg et al. | |
| 2011/0255805 | A1* | 10/2011 | Wang | 383/26 |

OTHER PUBLICATIONS

Written Opinion issued Jun. 28, 2012, in co-pending PCT Application PCT/US2012/031067 (6 pages).

* cited by examiner

SHOPPER BAG

BACKGROUND OF THE INVENTION

The invention relates generally to bags, and more particularly to a shopping bag a pair of handles and an auxiliary collar useful as a neck or shoulder strap.

A wide variety of conventional shopping bags with different size handles are available. This allows for a user to select a bag with a short pair of handles in order to carry it with a hand and not scrape along the ground. Other shopping bags include one long shoulder strap or a pair of long handles so that the bag can be carried over a user's shoulder. Alternatively, such bags may have both size handles or a pair of short handles and a single long handle suitable as a shoulder strap. These bags may have an open mouth or a cover so that articles to be carried are received within and can be removed from the bag.

When shopping bags have a pair of handles of the same length and shape, they generally extend from opposite sides of the bag opening. This allows the weight of the content to be evenly distributed and partially closes the bag opening between the handles. When a shoulder strap is present it often extends from the short sides of a rectangular opening.

Notwithstanding the wide variety of shopping bags available, it is desirable to provide a shopping bag having a pair of small handles and a larger collar suitable for use as a neck or shoulder strap so that the bag can be carried by hand or over the shoulder and protect the contents in both modes.

SUMMARY OF THE INVENTION

Generally speaking, in accordance with the invention, a bag of a flexible material or fabric having a firm or supporting bottom end and an open upper end for insertion of articles is provided. When open and upright, the bag has parallel front and back sides and two shorter sides. The front and back sides are larger than the shorter side so that the top opening is substantially rectangular. The bag includes a small upwardly extending handle on the front or back panel and a corresponding horizontal slit or opening on the other panel. The fabric above the slit functions as the second small handle. The panel with the small handle also includes a longer collar extending from the sides of the panel so that a user can place the collar about one's neck or over a shoulder. The collar may also be first slipped through the slit on the other panel to close the top opening before being worn as a neck or shoulder strap.

When the shopping bag is to be lifted using the small handles, a user may fold over the collar and extend the small handle on the same panel. The user then places a hand through the small handle and the upper part of the slit opening on the other panel. Alternatively, when the user wants to use the collar as a shoulder strap, the collar maybe slipped through the handle slit opening and pulled away from the opening about one's neck and over a shoulder. When the collar is slipped through the slit opening in this manner, the bag opening is closed protecting the contents in the bag.

Accordingly, it is an object of the invention to provide an improved shopping bag.

Another object of the invention is to provide a shopping bag having a pair of small handles and larger collar that can be used as a neck or shoulder strap.

A further object of the invention is to provide a shopping bag in which one of the pair of small handles is formed by the upper portion of a substantially horizontal slit opening in the front or back panel and the other panel includes a collar.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
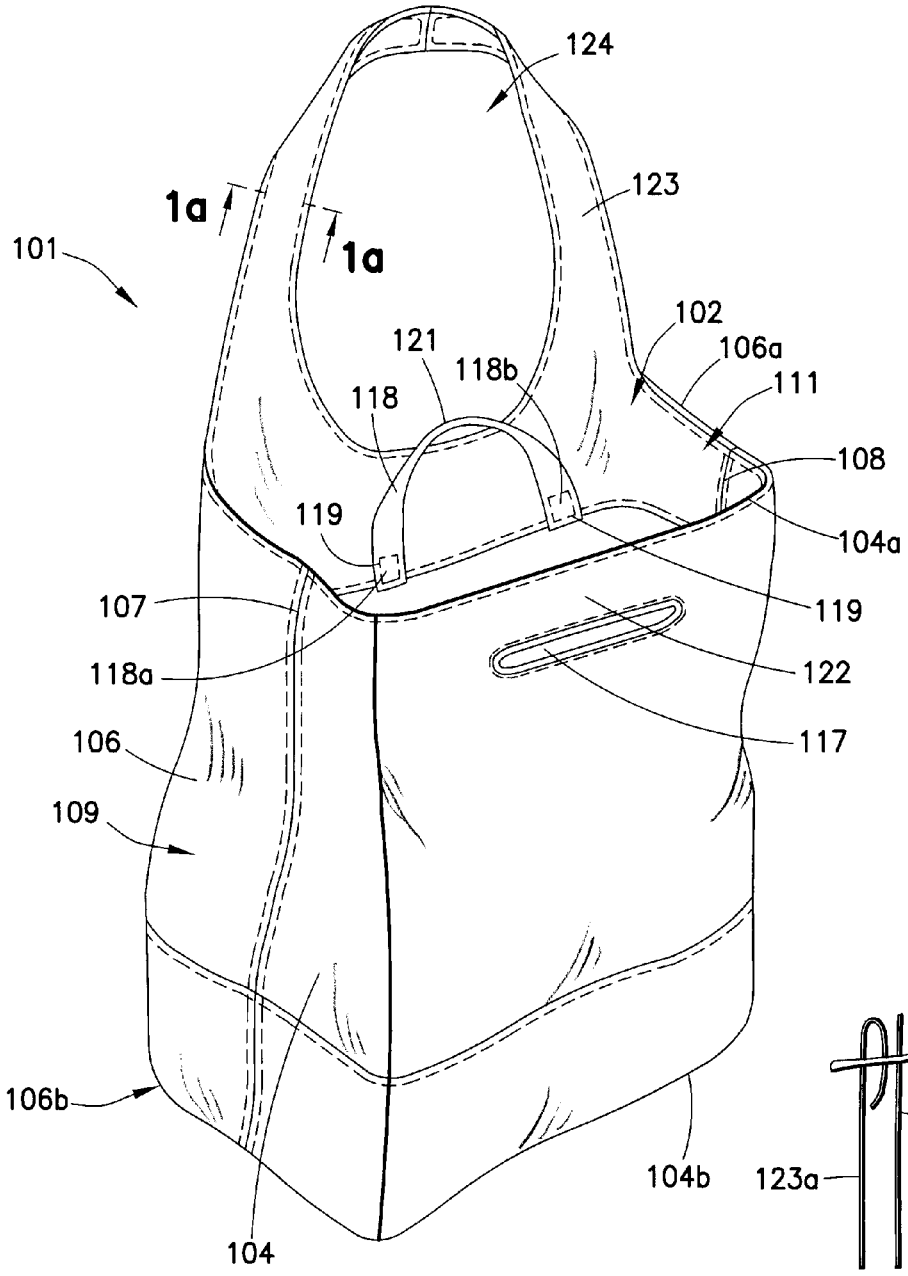
FIG. 1 is a perspective view of a shopper bag with handles and collar constructed and arranged in accordance with the invention.

FIG. 1 is a perspective view of a shopper bag 101 constructed and arranged in accordance with the invention. Bag 101 is made of a natural or synthetic flexible material. It may be a flexible synthetic plastic material or fabric. Natural materials, such as leather or a natural fabric, such as canvas are preferred.

Figure 4:
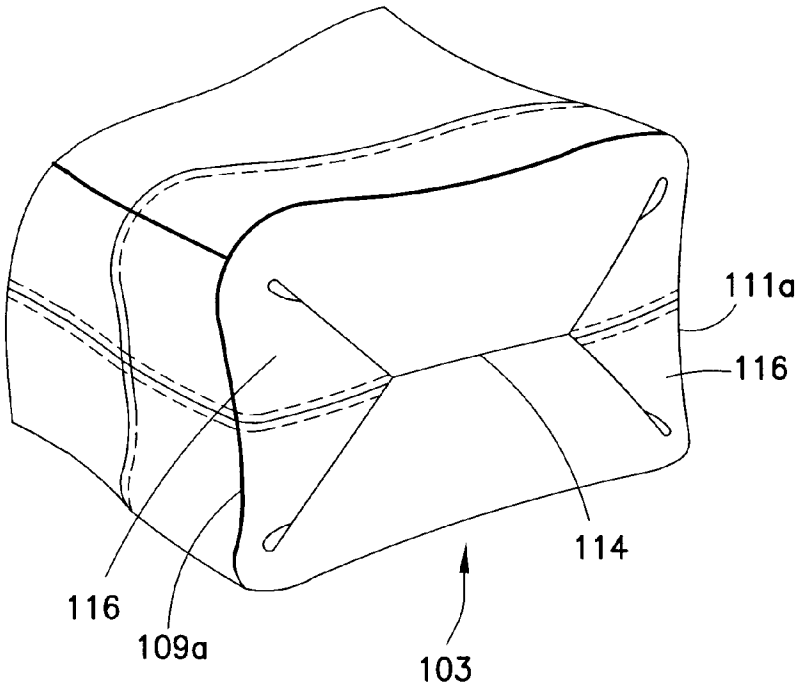
FIG. 4 is a perspective view of the bottom of the shopper bag of FIGS. 1-3.

Bag 101 is substantially rectangular in shape with an opening 102 at the top and a closed bottom 103 (shown in perspective in FIG. 4). Bag 101 is formed from a flexible front panel 104 and a rear panel 106 stitched together along a left stitch line 107 and a right stitch line 108 to form a tube with upper opening 102. Front panel 104 has an upper edge 104*a* and a lower front fold line 104*b* Rear panel 106 has an upper edge 106*a* and a lower fold line 106*b*. The tube formed after front panel 104 and rear panel 106 are stitched together is shaped into a rectangular form with a large front side and rear side and a smaller left side 109 and a corresponding smaller right side 111.

The lower portion of the tube is shaped into rectangular bottom 103 by folding left side 109 and right side 111 towards each other to form a left fold line 109*a* and a right fold line 111*b*. The lower edge of front panel 104 is then folded to form lower front edge 104*b* and rear panel 106 is folded to form lower fold line 106*b*. The folded edges are then joined at a bottom center line 114 to form gussets 116 and provide securely closed bottom 103.

A small curved handle 118 having ends 118*a* and 118*b* is secured to the inside surface of rear panel 106 by stitches 119 and has a handle apex 121. Front panel of bag 101 includes a slit 117 across an upper portion of front panel 104 to form a handle portion 122. Handle 118 is positioned on rear panel 106 so that handle apex 121 is about the same height of handle potion 122 of front panel 104 above slit 117. This allows a user to hold bag 101 with small handle 118 and handle portion of front panel 104 above slit 117 as shown in FIG. 2.

Figure 1A:
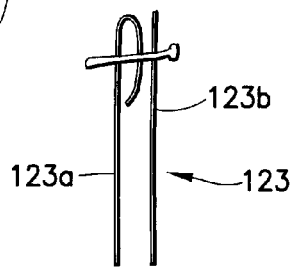
FIG. 1*a* is a cross-sectional view of the collar taken through line 1*a*-1*a;*

Rear panel 106 includes a collar 123 extending upwardly above and over handle 118 with a collar opening 124. Collar 123 is formed of the same flexible material as bag 101 and has a multi-layer construction as shown in the cross-section of FIG. 1*a* including an inner face 123*a* and an outer face 123*b*. Collar 123 extends from rear panel 106 as shown in FIG. 1 or may be a large separate handle joined to upper edge 106*a* of rear panel 106. While bag 101 is shown with collar 123 and handle 118 on rear panel 106, it is within the scope of the invention to reverse the position and have collar 123 and handle 118 on front panel 104.

Figure 2:
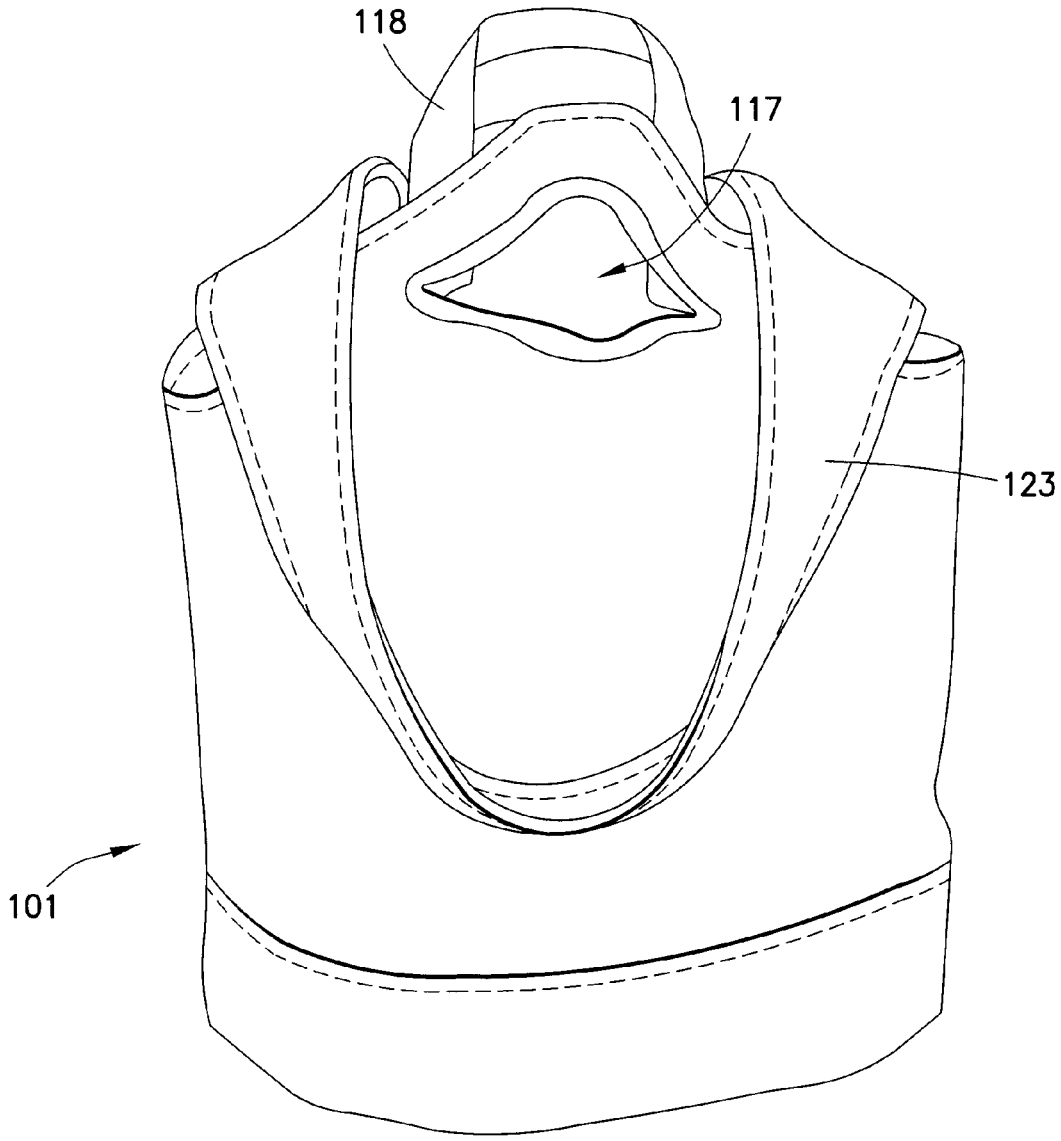
FIG. 2 is a perspective view of the shopping bag of FIG. 1 with collar draped over handles used to lift the bag in accordance with the invention.
Figure 3:
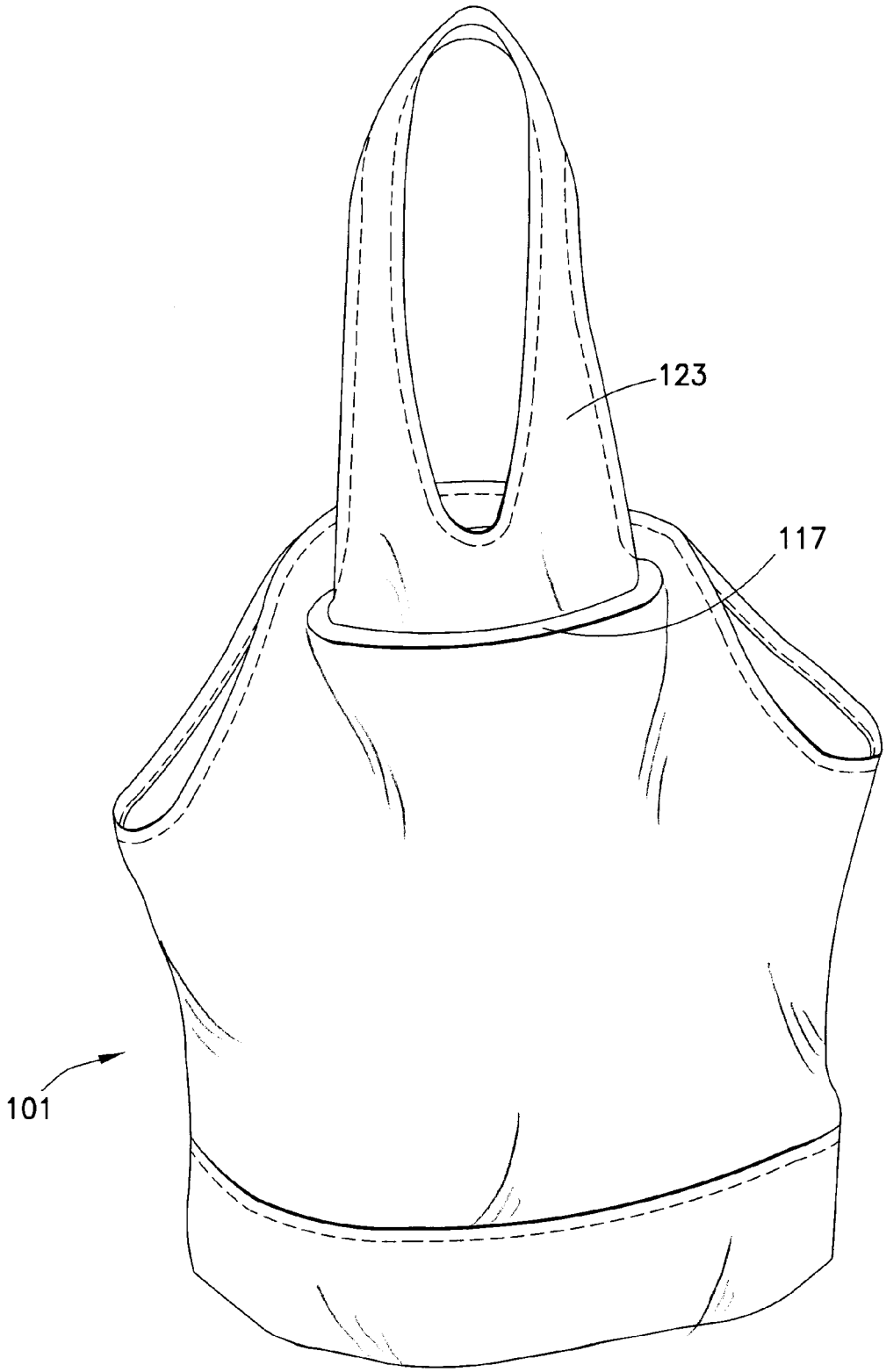
FIG. 3 is a perspective view of the shopping bag of FIG. 1 with collar slipped through a handle opening to allow the collar to be used as a neck or shoulder strap.

As shown in FIG. 2, handle 118 and front panel portion 122 may be used together to lift bag 101. Alternatively, as shown in FIG. 3, collar 123 may be passed through slit 117, pulled up to close opening 102 and be used as a neck or shoulder strap for bag 101.

Figure 5:
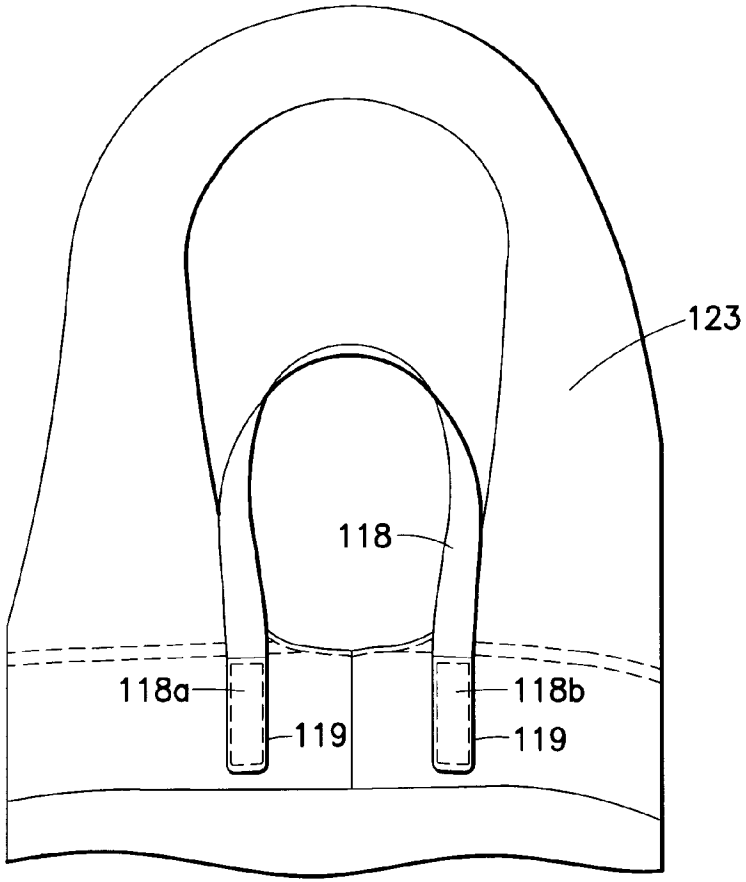
FIG. 5 is a plan view of a small handle and collar on one of the front or back panels of the shopper bag of FIG. 1.

Collar 123 is long enough to pass through slit 117 and provide collar opening 124 of sufficient length to be used as a neck or shoulder strap. A plan view of strap 118 and collar 123 is shown in FIG. 5.

The bottom view in FIG. 4 shows gussets 116 formed when bottom fold line 104*b* of front panel 104 and bottom fold line 106*b* of rear panel 106 are folded over to close bottom 103. When bag 101 is constructed from a leather or canvas material, there is sufficient stiffness in the material itself to maintain bottom 103 in the rectangular form as shown. If a lighter weight fabric is used, multiple layers with or without lining material may be used to provide the necessary stiffness.

Figure 7:
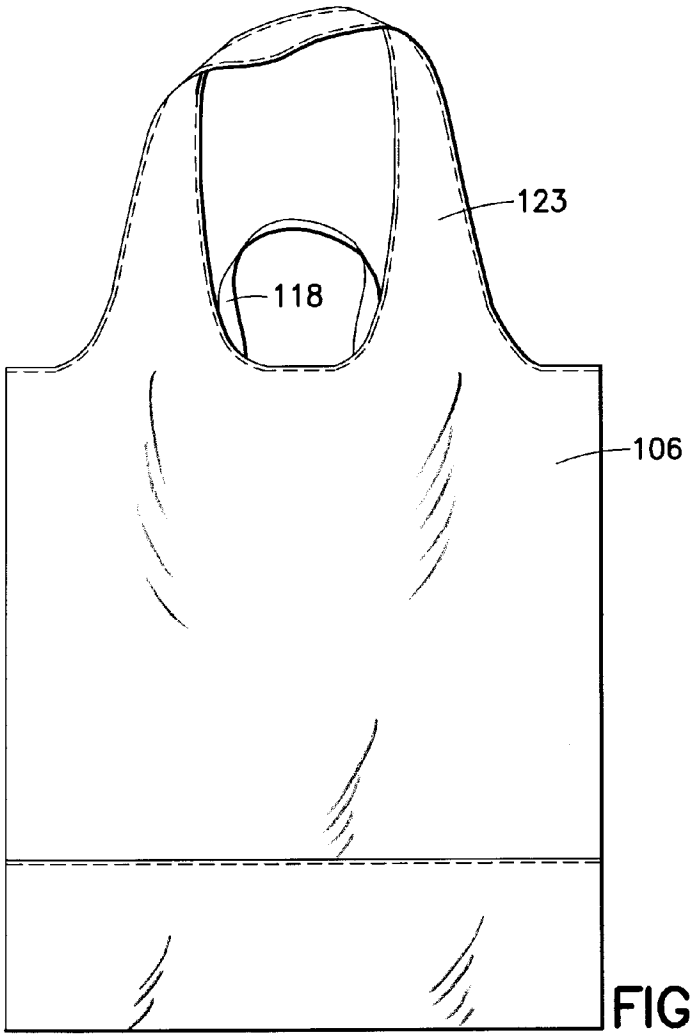
FIG. 7 is a front plan view showing the front or back panel with a collar and small handle.
Figure 6:
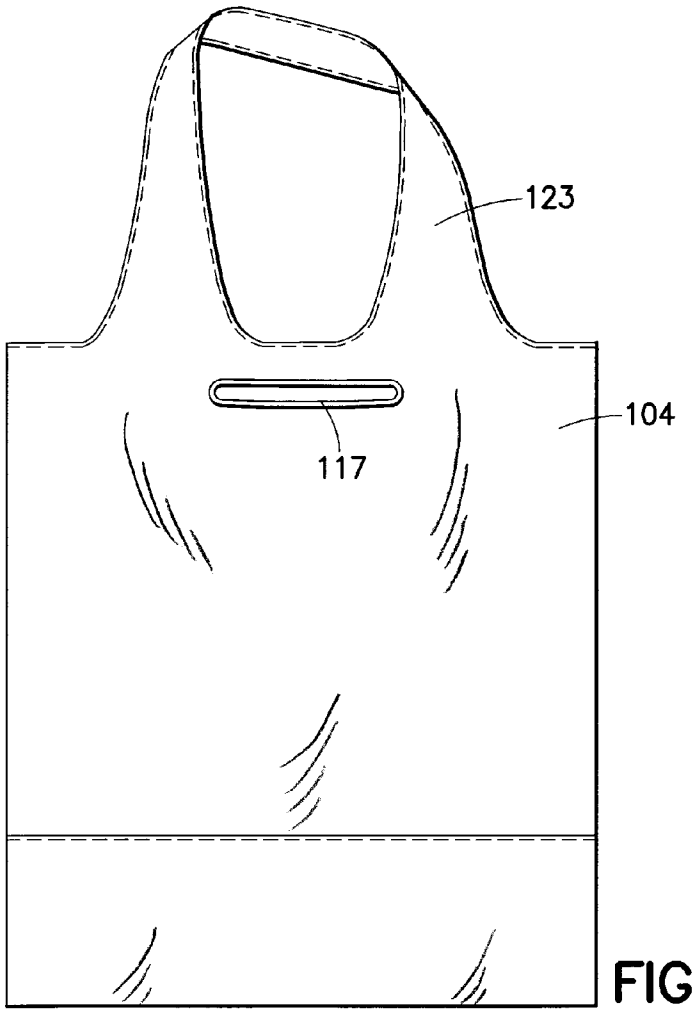
FIG. 6 is a plan view of one of the outer surfaces of front or back panel with a handle opening on the panel opposite the collar.

FIG. 6 is a plan view of bag 101 and front panel 104 with slit 117 and slit handle 122 and collar 123 extending above top edge 104*a* of front panel 104. FIG. 7 is a plan view of rear panel 106 with handle 118 shown extending into collar opening 124.

A shopping bag with a pair of small handles and a larger collar on one panel that fits into and through the other handle provides an improvement over a shopping bag with two large handles. By passing through one small handle, the top opening of the bag is closed to protect the contents and allow the user to support the bag on a shoulder.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A bag, comprising:
a flexible front panel having a top edge, a bottom edge and two side edges;
a flexible rear panel having a top edge, a bottom edge and two side edges;
the corresponding side edges joined together and the bottom edges folded into a rectangular shape and joined to form a closed rectangular bottom to form the bag with a rectangular open upper mouth;
at least one of the front and rear panels having a slit substantially parallel to and adjacent to the top edge thereof;
the other of the front and back panel having a small handle dimensioned to allow the top edge of the slit and small handle to be used to lift the bag; and
the panel with the small handle having a shoulder strap extending from the top edge and away therefrom that is longer than the small handle and dimensioned to fit through the slit on the other panel;
whereby when the shoulder strap is passed through the slit and the bag is lifted up, the front and back panels are drawn towards each other to close the open mouth of the bag.

2. The bag of claim 1, wherein the front and back panels are rectangular in shape.

3. The bag of claim 2, wherein the sides of the front and back panels are longer than the top and bottom edges.

4. The bag of claim 1, wherein the side edges of the front and back panels are joined to substantially rectangular side panels to form a substantially rectangular top opening.

5. The bag of claim 1, wherein the side edges are joined by stitches.

6. The bag of claim 1, wherein the bottom is formed by shaping the bag into a rectangular shape with the front and back panels larger than two sides and folding the bottom edges of the two sides towards each other and then folding the bottom edges of the front and back panels towards each other and joined together to close the bottom of the bag.

7. The bag of claim 6, wherein the outer edge of the shoulder strap extends from the sides of the front or rear panel with a central opening.

8. The bag of claim 1, wherein the small handle is mounted to the inside surface of the panel with the shoulder strap.

9. The bag of claim 8, wherein ends of the small handle are mounted a distance apart substantially the same as the opening of the shoulder strap.

10. The bag of claim 1, wherein the slit has substantially the same dimension same as the width of the small handle.

11. The bag of claim 1, wherein the shoulder strap is integral with an upper edge of one of the front and rear panels.

* * * * *